US009029675B2

(12) United States Patent
Meadows et al.

(10) Patent No.: US 9,029,675 B2
(45) Date of Patent: May 12, 2015

(54) PERCUSSION INSTRUMENT MOUNTING APPARATUS

(75) Inventors: Leslie Brian Meadows, Wellington (NZ); Andrew Heydenrych, Gauteng (ZA)

(73) Assignee: Leslie Brian Meadows, Wellington (NZ)

( * ) Notice: Subject to any disclaimer, the term of this patent is extended or adjusted under 35 U.S.C. 154(b) by 50 days.

(21) Appl. No.: 13/988,614

(22) PCT Filed: Nov. 22, 2011

(86) PCT No.: PCT/NX2011/000244
§ 371 (c)(1),
(2), (4) Date: Aug. 6, 2013

(87) PCT Pub. No.: WO2012/070956
PCT Pub. Date: May 31, 2012

(65) Prior Publication Data

US 2013/0319205 A1 Dec. 5, 2013

(30) Foreign Application Priority Data

Nov. 22, 2010 (NZ) ..... 589438

(51) Int. Cl.
*G10D 9/00* (2006.01)
*G10D 13/02* (2006.01)
(Continued)

(52) U.S. Cl.
CPC ..... *G10D 13/00* (2013.01); *G10G 5/00* (2013.01); *G10D 13/026* (2013.01); *G10D 13/06* (2013.01)

(58) Field of Classification Search
CPC ..... G10D 13/06; G10D 13/026; F16M 2200/022; G10G 5/00
USPC ..... 84/453, 421, 422.3; 984/154, 257
See application file for complete search history.

(56) References Cited

U.S. PATENT DOCUMENTS 3,299,765 A * 1/1967 Rochon ..... 84/422.3
4,158,981 A * 6/1979 Kurosaki ..... 84/421
(Continued)

OTHER PUBLICATIONS

International Search Report dated Mar. 19, 2012 corresponding to International Patent Application No. PCT/NZ2011/000244, 3 pp.
(Continued)

*Primary Examiner* — David Warren
*Assistant Examiner* — Christina Schreiber
(74) *Attorney, Agent, or Firm* — Ohlandt Greeley Ruggiero & Perle L.L.P.

(57) ABSTRACT

The invention relates to an apparatus for mounting a percussion instrument onto a stand. The apparatus comprises a support portion and a retaining portion, the support portion comprising a support member arranged for attachment to the stand and including a shaft, the retaining portion comprising a gripping member having a pair of elements spaced apart from each other and one or more spreader means arranged to urge the spaced apart elements away from each other, wherein the support and retaining portions are adapted to mount the percussion instrument therebetween, the shaft engageable with the retaining portion, the elements of the gripping member normally biased to a first position that is capable of retaining the shaft between the elements in a locked position in the said retaining portion, the elements movable to a second position in which the retaining portion can be received on or removed from the first position on the shaft, the elements movable from the first position to the second position by activation of the or each spreader means.

15 Claims, 13 Drawing Sheets

(51) Int. Cl.

| | |
|---|---|
| ***G10D 13/06*** | (2006.01) |
| ***G10G 5/00*** | (2006.01) |
| ***G10D 13/00*** | (2006.01) |

(56) References Cited

U.S. PATENT DOCUMENTS

| | | | | | |
|---|---|---|---|---|---|
| 4,216,695 | A | * | 8/1980 | Hoshino | 84/421 |
| 4,363,561 | A | * | 12/1982 | Hsieh | 403/92 |
| 4,365,535 | A | * | 12/1982 | Buttner et al. | 84/421 |
| 4,381,690 | A | * | 5/1983 | Kimble | 84/422.3 |
| 4,458,574 | A | * | 7/1984 | Hoshino | 84/422.3 |
| 4,488,471 | A | * | 12/1984 | Youakim | 84/422.3 |
| 4,526,083 | A | * | 7/1985 | LeMert | 84/421 |
| 4,960,028 | A | * | 10/1990 | Ramirez | 84/421 |
| 5,121,665 | A | * | 6/1992 | Myers et al. | 84/421 |
| 5,482,235 | A | * | 1/1996 | Atsumi | 248/121 |
| 5,785,480 | A | * | 7/1998 | Difeo | 411/433 |
| 5,918,300 | A | * | 6/1999 | Hsieh | 84/422.3 |
| 6,274,797 | B1 | * | 8/2001 | Liao | 84/421 |
| 6,747,200 | B2 | * | 6/2004 | Sato | 84/422.3 |
| 6,884,015 | B1 | * | 4/2005 | Takegawa | 411/433 |
| 7,629,526 | B1 | * | 12/2009 | Miyajima | 84/422.1 |
| 7,915,507 | B2 | * | 3/2011 | Onheiser | 84/421 |
| 8,334,448 | B2 | * | 12/2012 | Onheiser | 84/421 |
| 8,415,548 | B2 | * | 4/2013 | Johansen | 84/421 |
| 8,697,970 | B2 | * | 4/2014 | Harrison et al. | 84/402 |
| 8,710,342 | B2 | * | 4/2014 | Lin | 84/422.3 |
| 8,759,654 | B2 | * | 6/2014 | Nakata et al. | 84/421 |
| 2004/0094016 | A1 | * | 5/2004 | Hallerberg | 84/422.3 |
| 2005/0056137 | A1 | * | 3/2005 | DiPietro | 84/411 R |
| 2006/0096444 | A1 | * | 5/2006 | Sato et al. | 84/422.3 |
| 2006/0169124 | A1 | * | 8/2006 | Tanaka | 84/422.3 |
| 2014/0096664 | A1 | * | 4/2014 | Nakata et al. | 84/422.3 |

OTHER PUBLICATIONS

International Preliminary Report on Patentability dated Jul. 18, 2012 corresponding to International Patent Application No. PCT/NZ2011/000244, 9 pp.

* cited by examiner

*Embodiment 1 - Locked Position*

*Embodiment 1 - Locked Position*

*Embodiment 1 - Locked Position*

*Embodiment 1 - Unlocked Position*

*Embodiment 1 - Unlocked Position*

*Embodiment 1 - Unlocked Position*

*Embodiment 2 - Locked Position*

*Embodiment 2 - Locked Position*

*Embodiment 2 - Locked Position*

*Embodiment 2 - Unlocked Position*

*Embodiment 2 - Unlocked Position*

*Embodiment 2 - Unlocked Position*

*Embodiment 3 - Locked Position*

*Embodiment 3 - Locked Position*

*Embodiment 3 - Unlocked Position*

*Embodiment 3 - Unlocked Position*

PERCUSSION INSTRUMENT MOUNTING APPARATUS

The present invention relates to an apparatus for mounting one or more percussion instruments, such as a cymbal, bell, or gong, onto a stand.

BACKGROUND OF THE INVENTION

Cymbals are a common percussion instrument. The cymbals that are played by drummers in a band or orchestra are conventionally mounted onto a cymbal stand. To assist in being mounted, a cymbal has a centrally located, circular aperture that is sized to fit around an externally threaded cylindrical portion of the cymbal stand.

Most cymbal stands have legs which rest on the ground and a shaft which extends vertically from the legs. In some instances the cymbal is mounted onto the uppermost portion of the vertical shaft, while in other cases, the cymbal is mounted onto one end of a boom arm that is attached to the vertical shaft so as to position the cymbal closer to the drummer.

The conventional method of mounting a cymbal onto a stand involves the following steps. First, a plastic sleeve with an outwardly projecting rim is fitted over the lower end of the externally threaded portion of the shaft. A felt washer is then slipped over the plastic sleeve to sit on the rim of the sleeve, followed by the cymbal. A second felt washer is then placed over the cymbal and a wing nut screwed down upon the upper felt washer to hold the cymbal onto the cymbal stand.

This well known method of mounting a cymbal onto a stand suffers from several disadvantages. For example, the time taken to securely mount a cymbal onto a stand or to detach a securely mounted cymbal can be lengthy; the wing nut can be over-tightened and consequently cause damage to the cymbal when played; and the small nature of the separate parts involved means that the parts frequently get misplaced.

Quick-release fixtures to attach a cymbal onto a cymbal stand are known in the art, for example, U.S. Pat. No. 4,526,083 describes such a cymbal mounting fixture.

However, there are a number of difficulties and/or disadvantages associated with the cymbal mounting fixtures of the prior art, including that the fixture is susceptible to working itself loose and detaching itself from the cymbal stand as the cymbal is played.

It is an object of the invention to provide a percussion instrument mounting apparatus that will overcome at least some of the abovementioned difficulties and/or disadvantages.

SUMMARY OF THE INVENTION

According to an aspect of the invention, there is provided an apparatus for mounting a percussion instrument onto a stand, the apparatus comprising:

a support portion and a retaining portion, the support portion comprising a support member arranged for attachment to the stand and including a shaft, the retaining portion comprising a gripping member having a pair of elements spaced apart from each other and one or more spreader means arranged to urge the spaced apart elements away from each other, wherein the support and retaining portions are adapted to mount the percussion instrument therebetween, the shaft engageable with the retaining portion, the elements of the gripping member normally biased to a first position that is capable of retaining the shaft between the elements in a locked position in the said retaining portion, the elements movable to a second position in which the retaining portion can be received on or removed from the first position on the shaft, the elements movable from the first position to the second position by activation of the or each spreader means.

The shaft may be intended to pass through a mounting aperture in the instrument for quick release when the or each spreader means is activated.

The instrument may be secured to the retaining portion.

The retaining portion may comprise a first section and a second section, the first section being movable relative to the second section. The first section may be a dome-shaped cap having a cylindrically recessed underside and the second section may be an annular base with a centrally located channel for receiving a free end of the shaft, the base being sized to fit within the recess of the first section of the retaining portion.

The or each spreader means may be activated by pressing, pulling or rotating the first section of the retaining portion.

The elements of the gripping member may be a pair of mutually spaced apart parallel rods, each rod positioned on opposing sides of a channel in the retaining portion to receive a free end of the shaft, the spacing of the rods in the first position being capable of retaining the shaft in the locked position, the or each spreader means being configured, upon activation, to increase the distance between at least a portion of both rods and to move the rods into the second position. The rods may be made of any flexible material and may be spring rods.

In one embodiment the or each spreader means is activated by pressing the first section of the retaining portion, the first section being biased away from the second section by a spring member, the or each spreader means comprising two or more tapered protrusions on the first section, each protrusion being arranged, upon activation, to engage with a corresponding recess between the parallel rods of the gripping member on the second section and configured to increase the distance between at least a portion of both rods. Each protrusion may have a truncated conical shape.

In another embodiment the or each spreader means is activated by pulling the first section of the retaining portion, the or each spreader means comprising two or more elongated activator pins, each activator pin having opposing ends, one end having a wider diameter than the other end, the narrow end of each activator pin being fixed to the first section of the retaining portion, the wide end of each activator pin being movably housed within a recess inside the second section and configured, upon activation, to increase the distance between at least a portion of both rods of the gripping member.

In a further embodiment the or each spreader means is activated by rotating the first section of the retaining portion about the second section, the or each spreader means comprising two or more activator pins, each activator pin having opposing ends, one end fixed to the first section of the retaining portion and the other end free to move within a circular indentation in the second section, the free end of each pin abutting a free end of a rod of the gripping member on the second section and configured, upon activation, to increase the distance between at least a portion of both rods of the gripping member.

The shaft of the support member may be cylindrical and of a constant diameter throughout the length of the shaft except for a neck near a free end of the shaft, the neck being a circumferential groove cut into the shaft, the elements of the gripping member being configured to grip the neck of the shaft in the first position to retain the shaft in the locked position.

The support portion of the apparatus may include an elongated hollow cylindrical sleeve having a first end and a second end, the sleeve being sized to fit over the shaft of the support member, the first end of the sleeve adapted to engage with the second section of the retaining portion, the second end of the sleeve having an outwardly projecting rim arranged to sit on a shoulder of the support member.

The apparatus may include one or more felt washers above and below the instrument on the shaft.

The percussion instrument may be a cymbal, bell, or gong.

DETAILED DESCRIPTION OF THE INVENTION

Several embodiments of the apparatus for mounting a percussion instrument onto a stand will now be described, by way of example only, with reference to the accompanying drawings in which.

Figure 1:
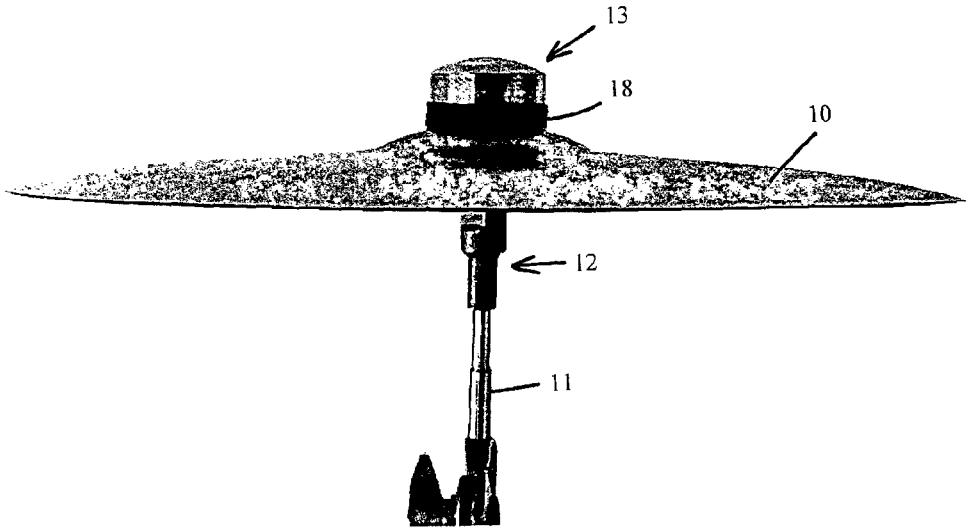
FIG. 1 is a side view of a cymbal mounted onto a cymbal stand using the apparatus according to the invention.

As shown in FIG. 1, the apparatus is designed to allow a cymbal 10 to be quickly and securely attached to or detached from a cymbal stand 11. However, it will be understood that the apparatus could be used to mount any other suitable percussive instrument onto a stand. The cymbal and the stand are both conventional items, with the cymbal having a circular mounting aperture in the centre of the cymbal and the cymbal stand having an externally threaded cylindrical portion for use in mounting the cymbal.

The apparatus comprises a support portion and a retaining portion, the support portion comprising a support member 12 arranged for attachment to the stand 11 and including a shaft 12*b*, the retaining portion comprising a gripping member having a pair of elements, 14*a* and 14*b*, spaced apart from each other and one or more spreader means, 21 or 23, arranged to urge the spaced apart elements away from each other, wherein the support and retaining portions are adapted to mount the percussion instrument therebetween, the shaft engageable with the retaining portion, the elements of the gripping member normally biased to a first position that is capable of retaining the shaft between the elements in a locked position in the said retaining portion, the elements movable to a second position in which the retaining portion can be received on or removed from the first position on the shaft, the elements movable from the first position to the second position by activation of the or each spreader means.

Figure 2:
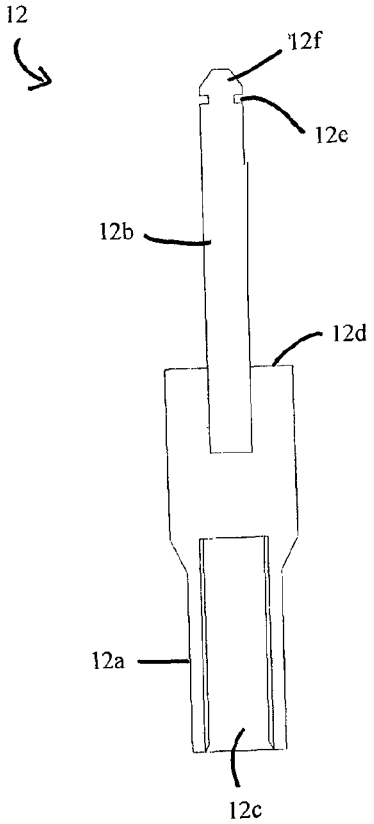
FIG. 2 is a cross-sectional view of the support member shown in FIG. 1.

The mounting of the cymbal to the stand by means of the apparatus may be described as follows. First, the support member 12 is secured onto the cymbal stand 11. As shown in FIG. 2, the support member is an elongated body with a proximal end and a distal end. Extending longitudinally from an opening at the proximal end is a cylindrical coupling 12*a* having an internally threaded bore 12*c*. A cylindrical portion of the cymbal stand 11 with an external screw thread may be threadedly engaged in the coupling bore 12*c* to secure the support element 12 to the cymbal stand.

At the distal end of the support member 12 is a cylindrical shaft 12*b* which extends longitudinally from a shoulder 12*d* of the body of the support member, the surface of the shoulder being perpendicular to the axis of the shaft. The shaft 12*b* is of a constant diameter throughout the length of the shaft except for a neck 12*e* positioned near the distal end of the shaft, the neck being a circumferential groove cut into the shaft. At the most distal portion of the shaft, beyond the neck, is a tapered tip 12*f*. The support member may be made of any suitable metal or alloy, such as steel.

Figure 3:
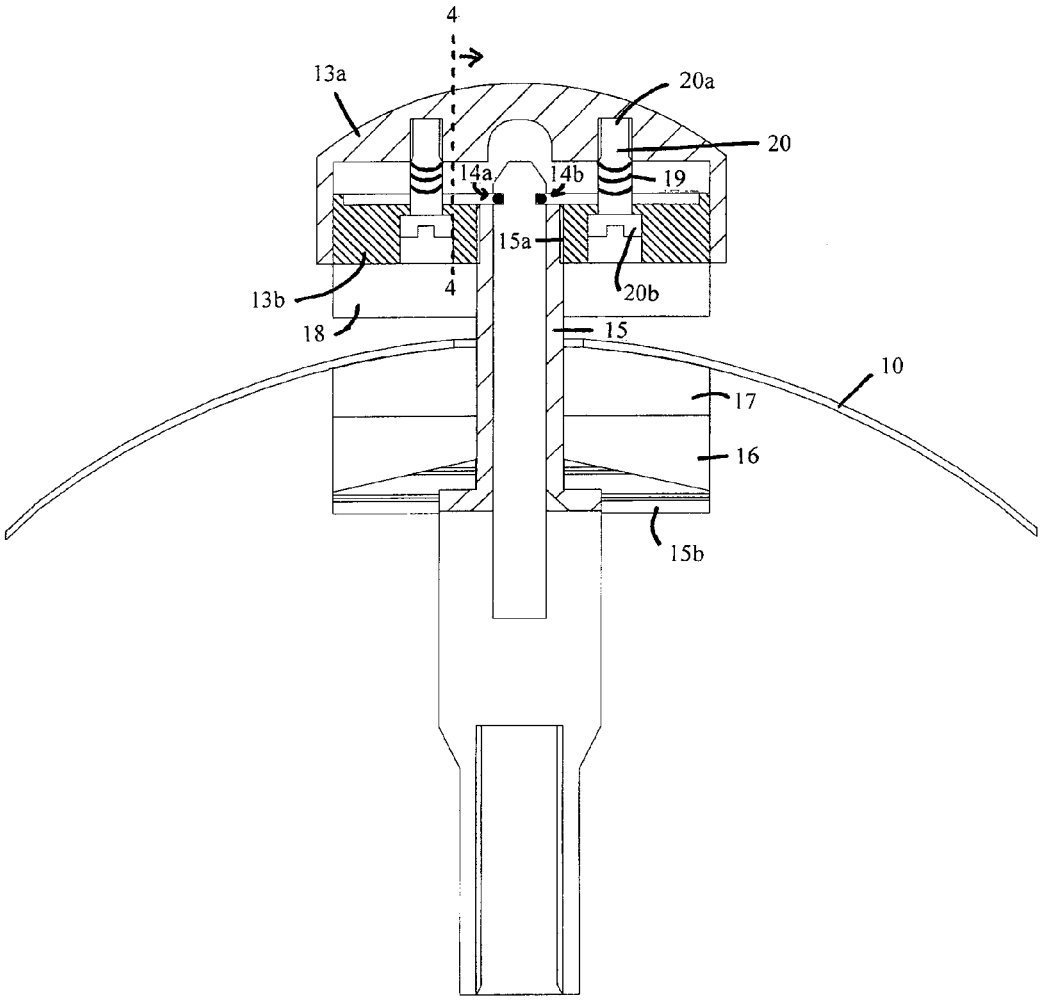
FIG. 3 is a cross-sectional view of a first embodiment of an apparatus according to the invention with the elements of the gripping member in a closed position.

As shown in FIG. 3, an elongated hollow cylindrical sleeve 15 having a first end and a second end is placed over the shaft 12*b* of the support member. The first end of the sleeve has an externally threaded portion 15*a* adapted to engage with an internally threaded channel 13*c* in a locking part 13 in the retaining portion. The second end of the sleeve has an outwardly projecting rim 15*b* arranged to sit on the shoulder 12*d* of the support member. The sleeve may be made of any suitable material or combination of materials, such as metal for the first end and plastic for the rim. Two felt washers 16, 17 are placed over the first end of the sleeve to sit on the rim of the sleeve, followed by the cymbal 10.

The neck 12*e* and tip 12*f* of the shaft are arranged to engage with the locking part in the retaining portion above the cymbal 10. The locking part 13 consists of two principal sections, namely a dome-shaped cap 13*a* having a cylindrically recessed underside; and an annular base 13*b* with a centrally located channel 13*c* for receiving the free end of the shaft 12*b*, the base being sized to fit within the recess of the cap. The two sections of the locking part may be made of any suitable metal or alloy, such as steel. A felt washer 18 is fixed to the base 13*b* of the locking part to provide flexible cushioning for the cymbal 10 so that the cymbal can vibrate after being struck during the course of being played. The cap 13*a* is movable relative to the base 13*b* of the locking part and the release mechanism may be activated by pressing, pulling or rotating the cap 13*a* of the locking part.

Figure 4:
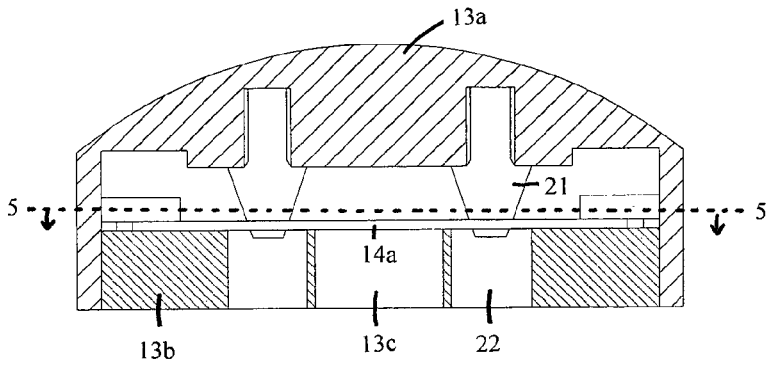
FIG. 4 is a cross-sectional view of the retaining portion taken substantially along line 4-4 of FIG. 3.
Figure 5:
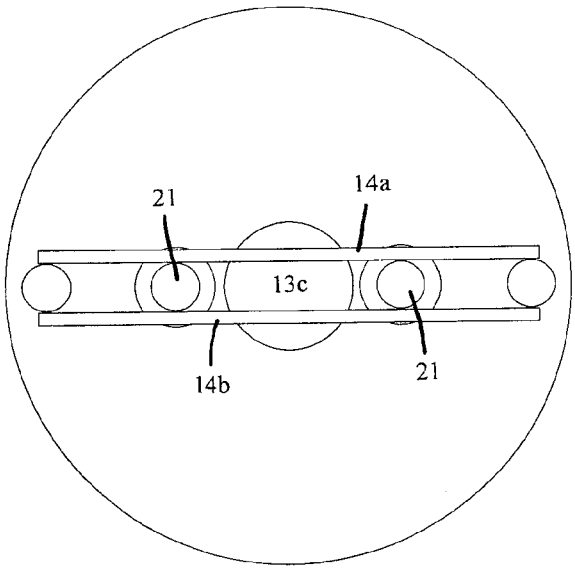
FIG. 5 is a simplified cross-sectional view of the retaining portion taken substantially along line 5-5 of FIG. 4.
Figure 6:
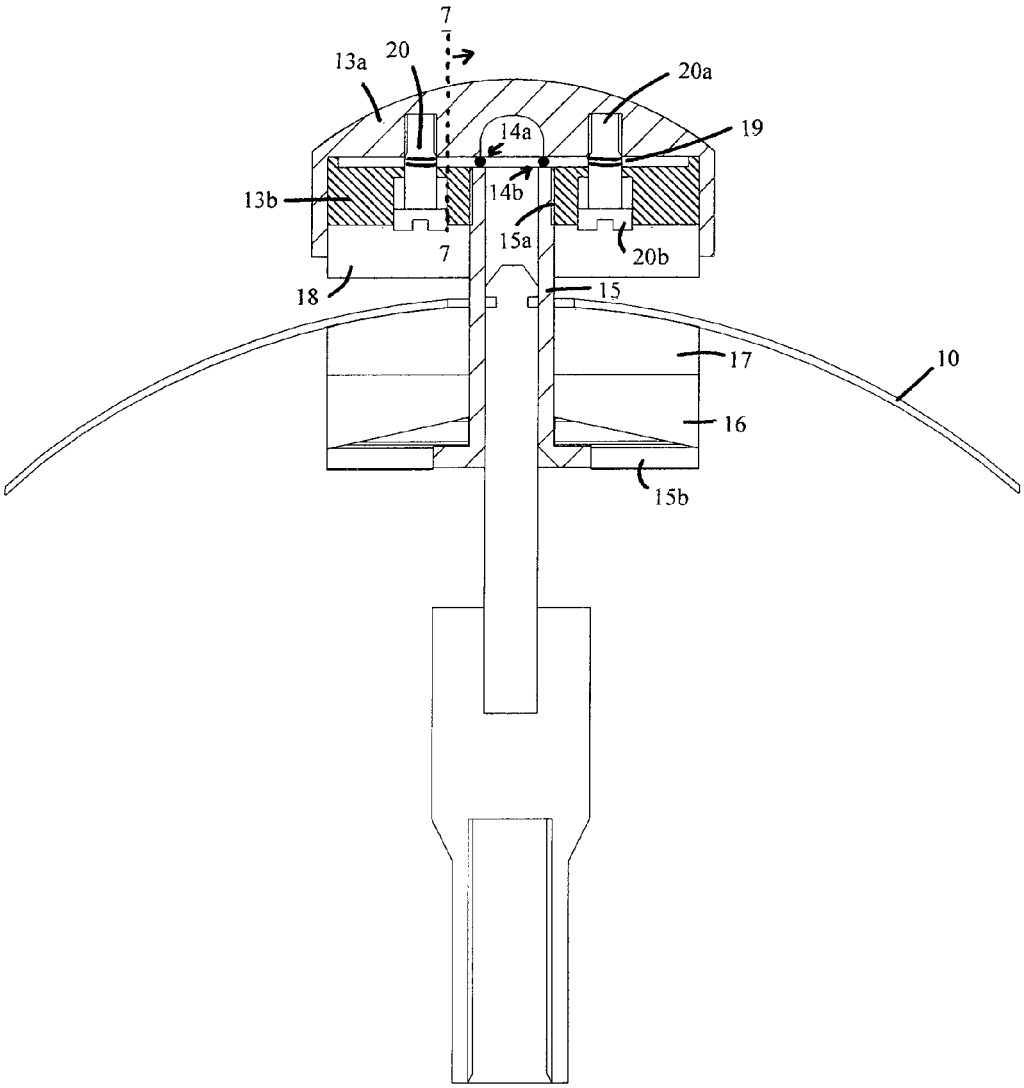
FIG. 6 is a cross-sectional view of the apparatus shown in FIGS. 3 to 5 with the elements of the gripping member in a release position.
Figure 7:
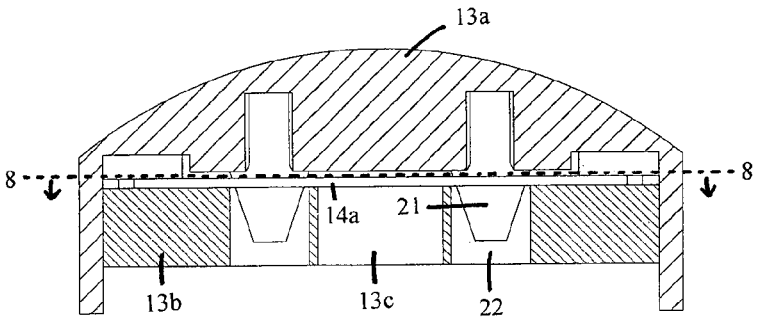
FIG. 7 is a cross-sectional view of the retaining portion taken substantially along line 7-7 of FIG. 6.
Figure 8:
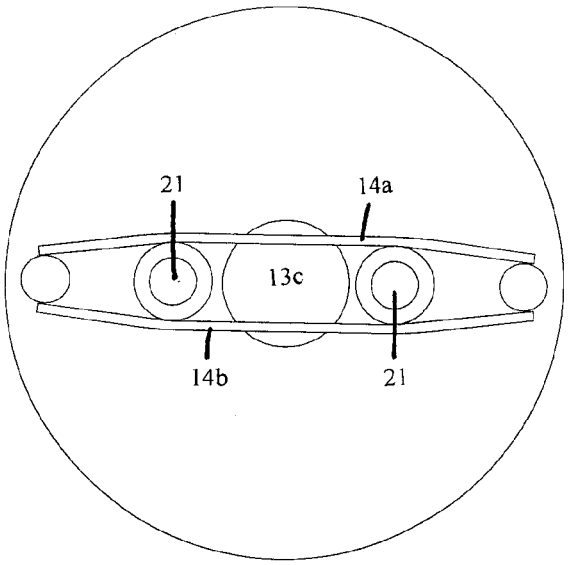
FIG. 8 is a simplified cross-sectional view of the retaining portion taken substantially along line 8-8 of FIG. 7.

FIGS. 3 through 8 show an embodiment of the apparatus in which the release mechanism is activated by pressing the cap. FIGS. 3, 4 and 5 show the apparatus in its 'locked' state with the elements of the gripping member, 14*a* and 14*b*, in the closed position and the shaft 12*b* being retained in a locked position in the locking part 13. FIGS. 6, 7 and 8 show the apparatus in its 'unlocked' state with the gripping member elements 14*a* and 14*b* in the release position in which the shaft 12*b* can be received in or retracted from the locking position within the locking part 13.

As shown in FIG. 3, the cap 13*a* is biased away from the base 13*b* by a spring member 19 attached to an elongated guide pin 20 (two of the four guide pins are shown). Each guide pin has opposing ends, one end having a wider diameter than the other end. The narrow end 20*a* of each guide pin is fixed to the cap 13*a*. The wide end 20*b* of each guide pin is movably housed within a recess inside the base 13*b*. When the cap 13*a* of the locking part is pressed to unlock the apparatus, the spring members 19 are compressed and the cap is brought into closer proximity to the base 13*b* (shown in FIG. 6).

Best shown in FIG. 5, the gripping member comprises a pair of mutually spaced apart parallel flexible spring rods 14*a* and 14*b*, each rod being positioned on opposing sides of the centre of the channel 13*c* in the locking part to receive the shaft 12*b*, the spacing of the rods in the closed position being capable of retaining the shaft in the locking position by gripping the neck 12*e* of the shaft, the release mechanism being configured, upon activation, to increase the distance between at least a portion of both rods and to move the rods into the release position (shown in FIG. 8).

As shown in FIG. 4, the spreader means comprises two tapered protrusions 21 mounted to the underside of the cap 13*a*. Each protrusion is arranged, upon activation, to engage with a corresponding recess 22 between the parallel rods 14*a* and 14*b* of the gripping member on the base 13*b* and configured to increase the distance between at least a portion of both rods (as shown in FIG. 7) so that the shaft 12*b* can be received in or retracted from the locked position within the locking part 13.

Figure 9:
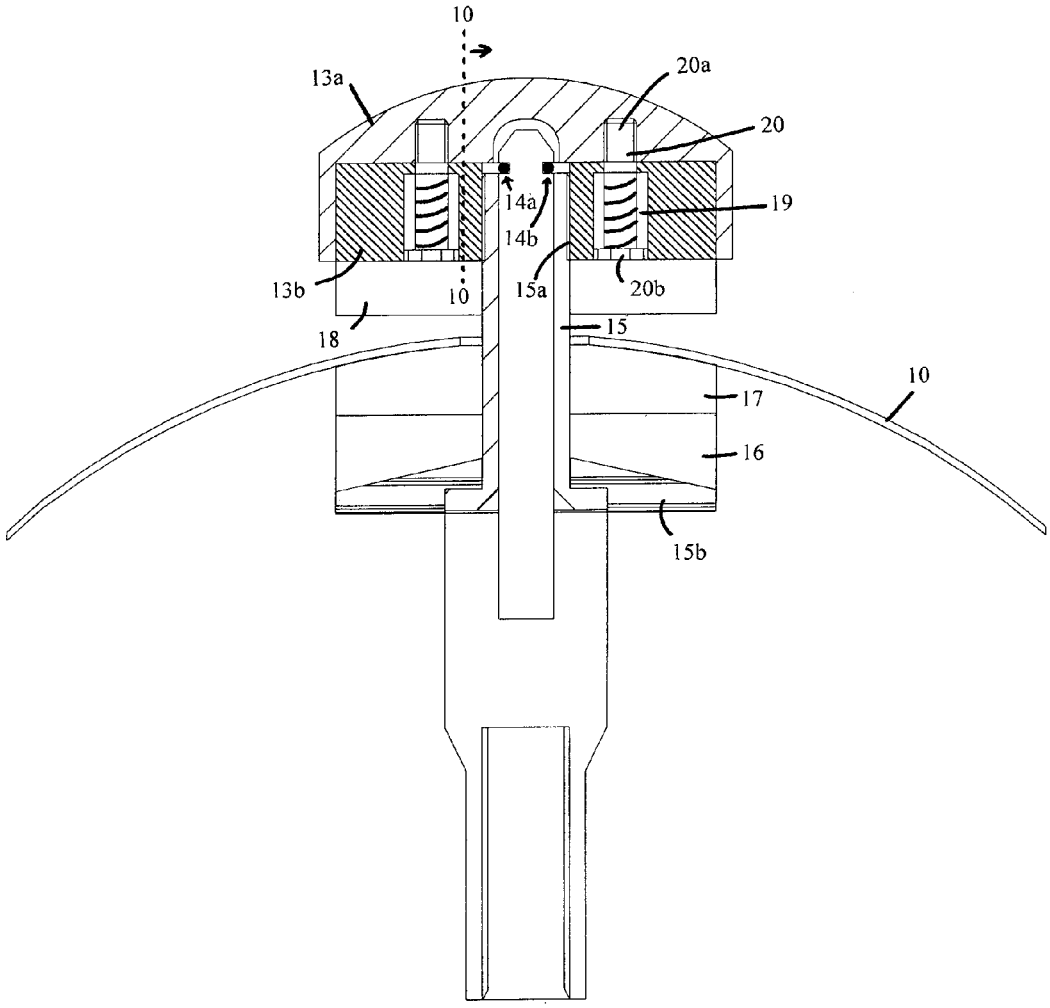
FIG. 9 is a cross-sectional view of a second embodiment of an apparatus according to the invention with the elements of the gripping member in a closed position.
Figure 10:
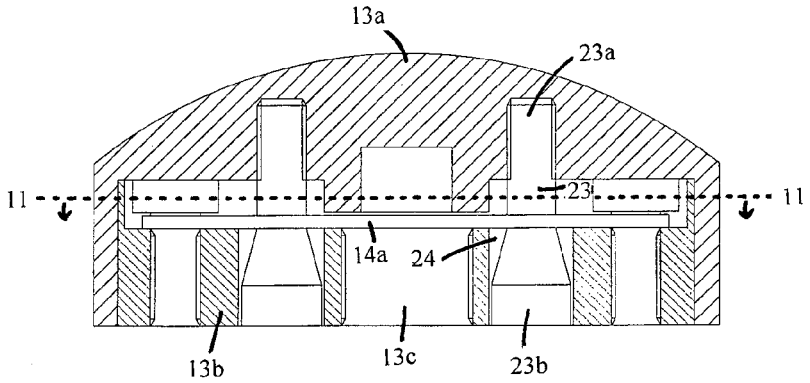
FIG. 10 is a cross-sectional view of the retaining portion taken substantially along line 10-10 of FIG. 9.
Figure 11:
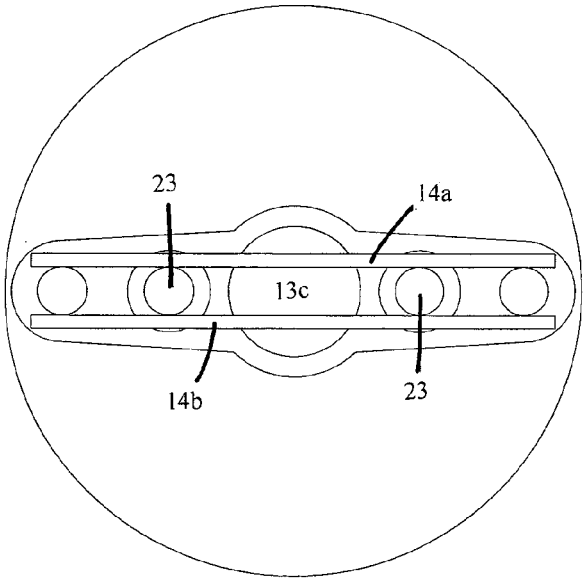
FIG. 11 is a simplified cross-sectional view of the retaining portion taken substantially along line 11-11 of FIG. 10.
Figure 12:
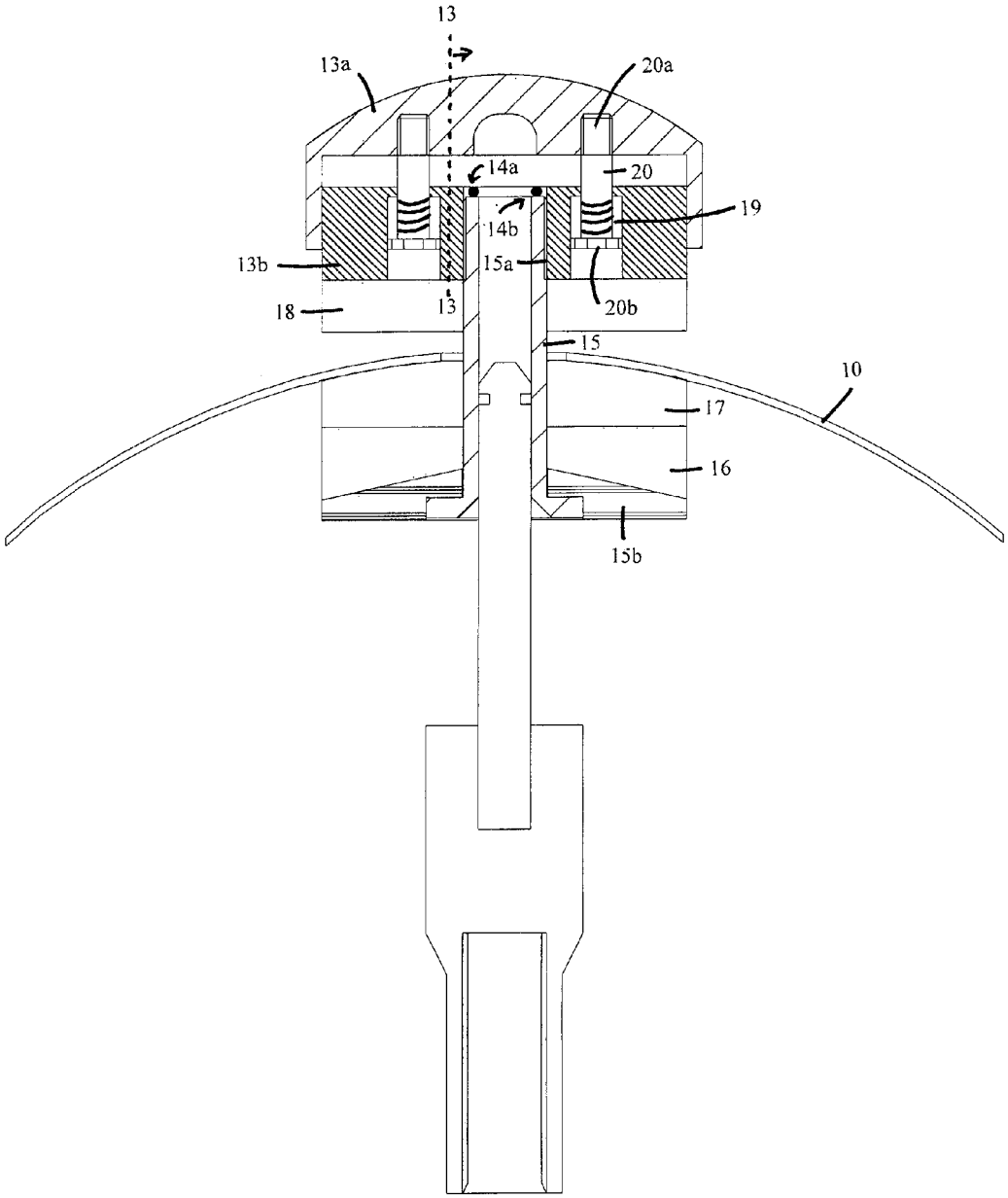
FIG. 12 is a cross-sectional view of the apparatus shown in FIGS. 9 to 11 with the elements of the gripping member in a release position.
Figure 13:
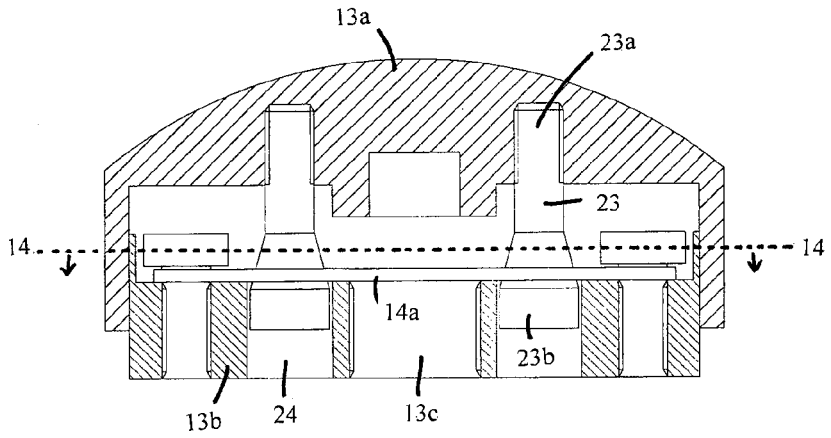
FIG. 13 is a cross-sectional view of the retaining portion taken substantially along line 13-13 of FIG. 12.
Figure 14:
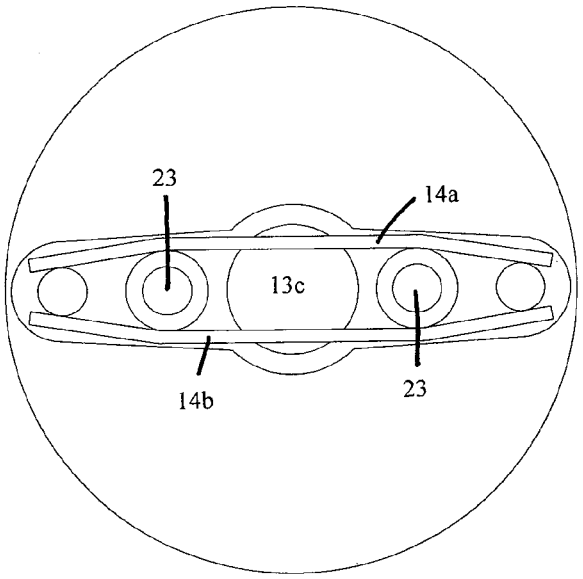
FIG. 14 is a simplified cross-sectional view of the retaining portion taken substantially along line 14-14 of FIG. 13.

FIGS. 9 through 14 show another embodiment of the apparatus in which the release mechanism is activated by pulling the cap 13*a*. FIGS. 9, 10 and 11 show the apparatus in its 'locked' state with the gripping member elements 14*a* and 14*b* in the closed position and the shaft 12*b* being retained in a locked position in the locking part 13. FIGS. 12, 13 and 14 show the apparatus in its 'unlocked' state with the gripping member elements 14*a* and 14*b* in the release position in which the shaft 12*b* can be received in or retracted from the locking position within the locking part 13.

Unlike in the first embodiment, the cap 13*a*, as shown in FIG. 9, is biased towards the base 13*b* by a spring member 19 attached to an elongated guide pin 20 (two of the four guide pins are shown). Each guide pin has opposing ends, one end having a wider diameter than the other end. The narrow end 20*a* of each guide pin is fixed to the underside of the cap 13*a*. The wide end 20*b* of each guide pin is movably housed within a recess inside the base 13*b* together with the spring member 19. When the cap 13*a* of the locking part is pulled to unlock the apparatus, the spring members 19 are compressed and the cap is moved further apart from the base 13*b* (shown in FIG. 12).

As shown in FIG. 10, the spreader means comprises two elongated activator pins 23. Each activator pin has opposing ends, one end having a wider diameter than the other end. The narrow end 23*a* of each activator pin is fixed to the underside of the cap 13*a*. The wide end 23*b* of each activator pin is movably housed within a recess 24 inside the base 13*b* and configured, upon activation, to increase the distance between at least a portion of both rods of the gripping member (as shown in FIG. 13) so that the shaft 12*b* can be received in or retracted from the locked position within the locking part 13.

Figure 15:
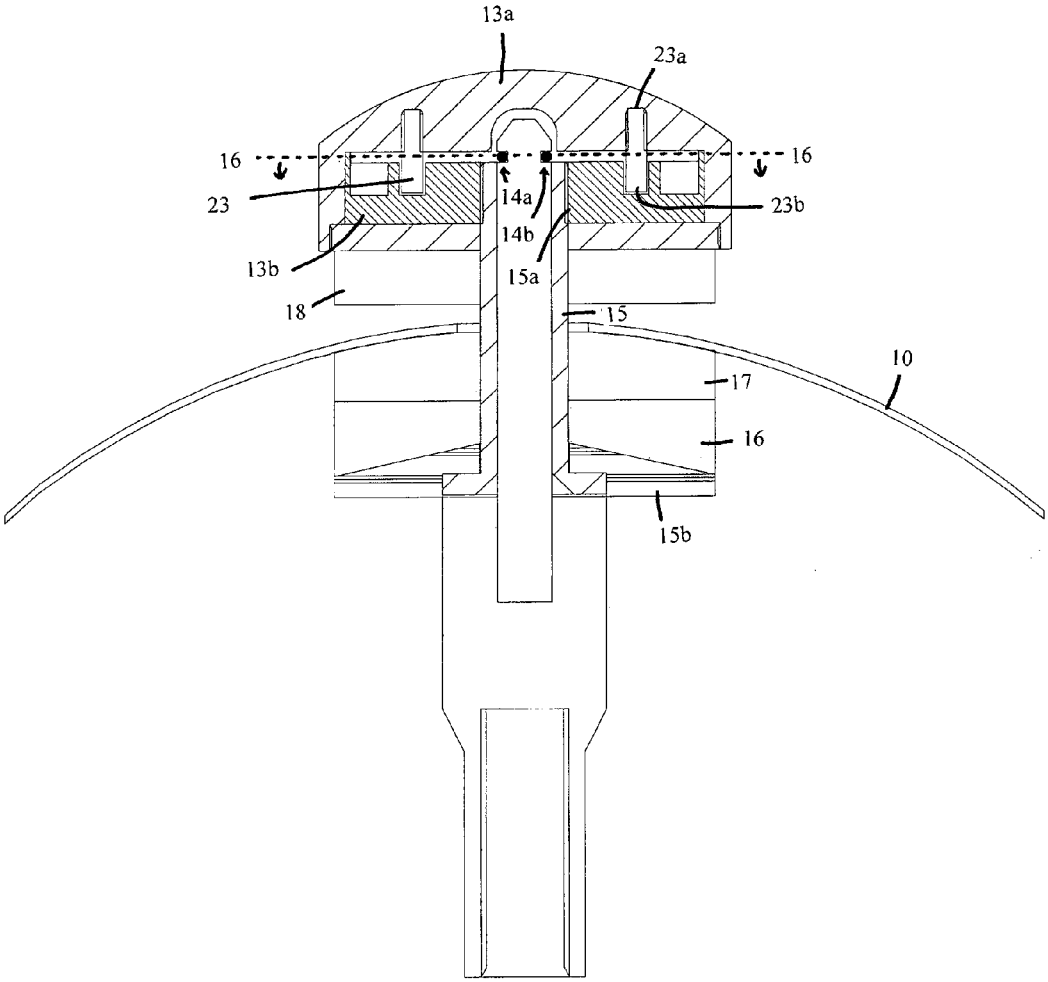
FIG. 15 is a cross-sectional view of a third embodiment of an apparatus according to the invention with the elements of the gripping member in a closed position.
Figure 16:
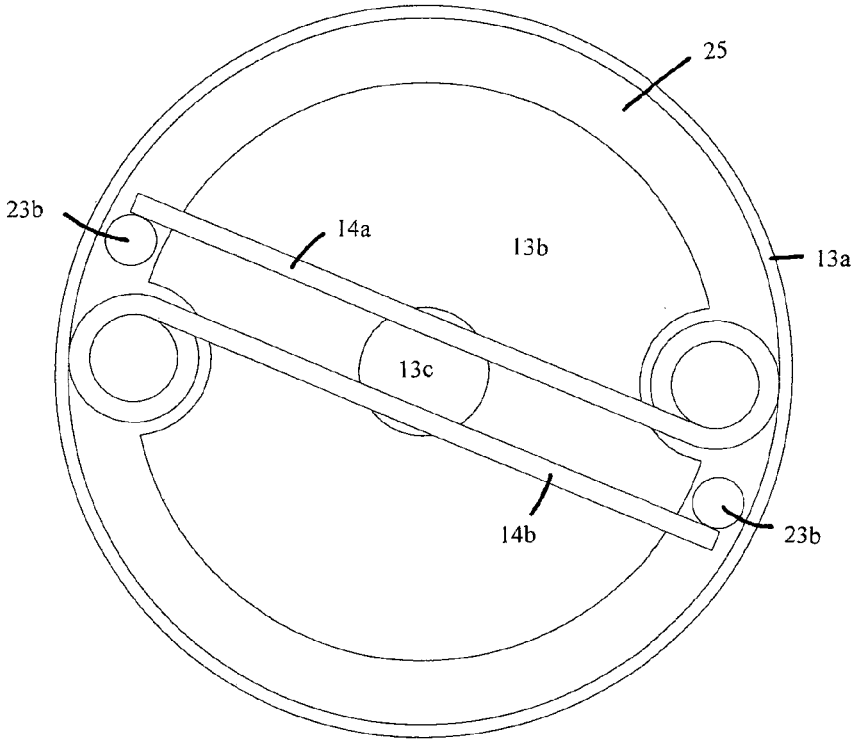
FIG. 16 is a simplified cross-sectional view of the retaining portion taken substantially along line 16-16 of FIG. 15.
Figure 17:
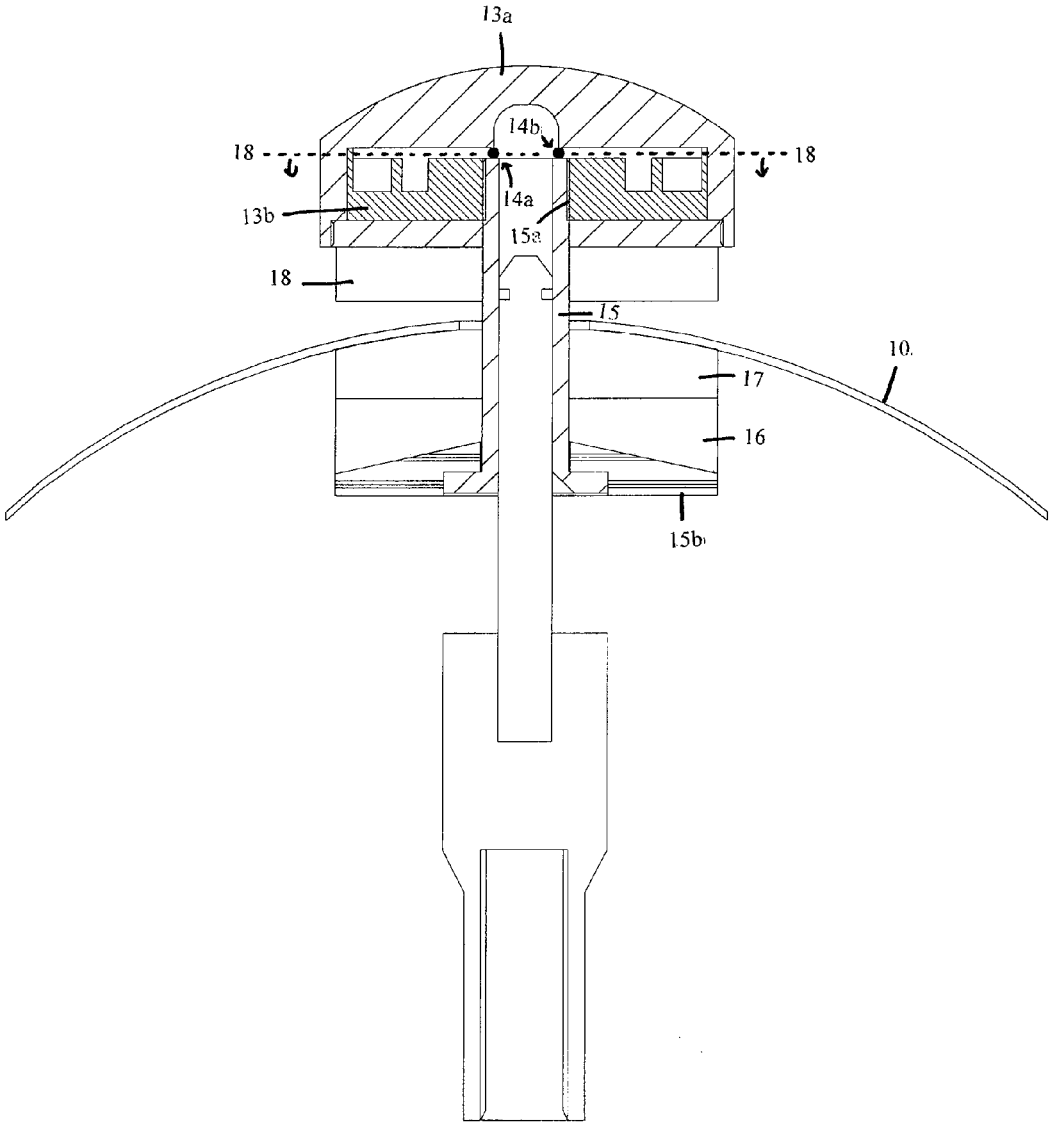
FIG. 17 is a cross-sectional view of the apparatus shown in FIGS. 15 and 16 with the elements of the gripping member in a release position.
Figure 18:
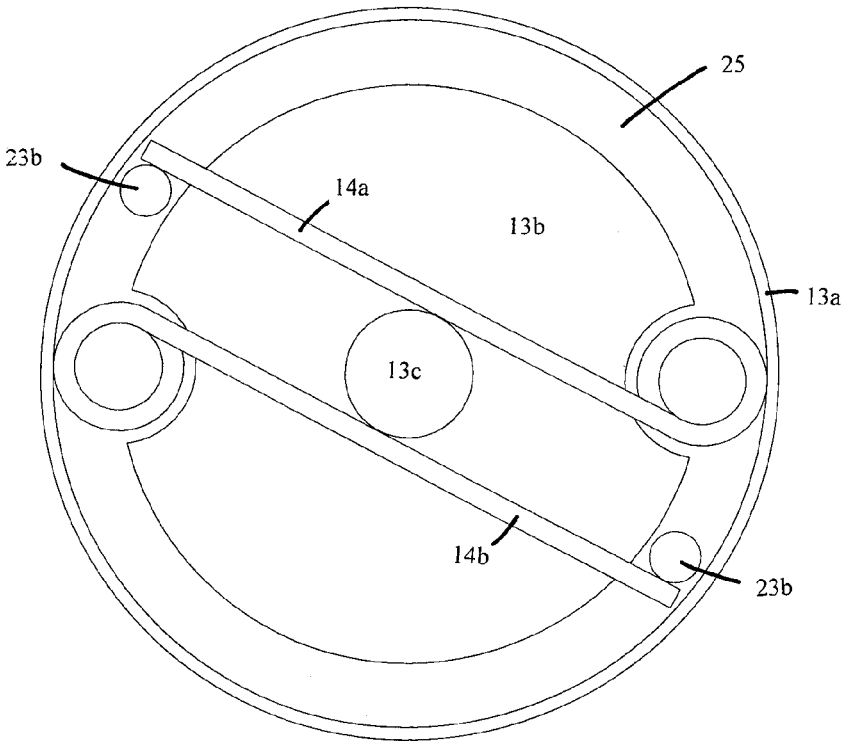
FIG. 18 is a simplified cross-sectional view of the retaining portion taken substantially along line 18-18 of FIG. 17.

FIGS. 15 through 18 show a further embodiment of the apparatus in which the release mechanism is activated by rotating the cap 13*a* about the stationary base 13*b*. FIGS. 15 and 16 show the apparatus in its 'locked' state with the gripping member elements 14*a* and 14*b* in the closed position and the shaft 12*b* being retained in a locked position in the locking part 13. FIGS. 17 and 18 show the apparatus in its 'unlocked' state with the gripping member elements 14*a* and 14*b* in the release position in which the shaft 12*b* can be received in or retracted from the locked position within the locking part 13.

As shown in FIG. 15, the spreader means comprises two elongated activator pins 23. Each activator pin has opposing ends, one end 23*a* is fixed to the underside of the cap 13*a* and the other end 23*b* is free to move within a circular indentation 25 in the base 13*b*. The free end of each pin abuts a free end of a rod 14*a* or 14*b* of the gripping member on the base 13*b* and is configured, upon activation, to increase the distance between at least a portion of both rods of the gripping member (as shown in FIG. 18) so that the shaft 12*b* can be received in or retracted from the locked position within the locking part 13.

The apparatus allows for the quick release of the shaft 12*b* from the locked position within the locking part 13 when the spreader means is activated. Importantly the apparatus is not susceptible to working itself loose and detaching itself from the cymbal stand 11 as the cymbal 10 is played. Because the locking part sits on the shoulder 12*d* of the support member 12 in the mounted position, the locking part can rotate freely about the shaft of the support member without the risk of detachment.

While some preferred aspects of the invention have been described by way of example, it should be appreciated that modifications and/or improvements can occur without departing from the scope of the invention as set out in this specification.

The terms comprise, comprises, comprising, or comprised, if and when used herein, should be interpreted non-exclusively, that is, as conveying "consisting of or including".

What is claimed is:

1. An apparatus for mounting a percussion instrument onto a stand, the apparatus comprising:

a support portion and a retaining portion, the support portion comprising a support member arranged for attachment to the stand and including a shaft with a tapered tip, the retaining portion comprising a first section and a second section, the first section being moveable relative to the second section, a gripping member having a pair of elements spaced apart from each other and one or more spreader means locatable between the elements of the gripping member and operable to urge the spaced apart elements away from each other;

and an elongated hollow cylindrical sleeve having a first end and a second end, the sleeve being sized to fit over the shaft of the support member, the first end of the sleeve adapted to engage with the second section of the retaining portion, the second end of the sleeve having an outwardly projecting rim arranged to sit on a shoulder of the support member;

wherein the support and retaining portions are adapted to mount the percussion instrument therebetween, the tapered tip of the shaft being engageable with the retaining portion so as to urge the elements of the gripping member away from each other, the elements being normally biased to a first position in which the gripping member is capable of retaining the shaft between the elements in a locked position of the said retaining portion, the elements being movable to a second position in which the retaining portion can be received into or removed from the locked position on the shaft, the elements being movable from the first position to the second position by actuation of the or each spreader means.

2. The apparatus according to claim 1, wherein the shaft includes a recess arranged to receive a gripping member when the retaining portion is in the locked position.

3. The apparatus according to claim 1, wherein the shaft is intended to pass through a mounting aperture in the instrument for quick release on actuation of the or each spreader means.

4. The apparatus according to claim 1, wherein the instrument is secured to the retaining portion.

5. The apparatus according to claim 1, wherein the first section is a dome-shaped cap having a cylindrically recessed underside and the second section is an annular base with a centrally located channel for receiving the tapered tip of the shaft, the base being sized to fit within the recess of the first section of the retaining portion.

6. The apparatus according to claim 1, wherein the or each spreader means is actuated by pressing, pulling or rotating the first section of the retaining portion.

7. The apparatus according to claim 1, wherein the shaft of the support member is cylindrical and of a constant diameter throughout the length of the shaft except for a neck near a free end of the shaft and the tapered tip, the neck being a circumferential groove cut into the shaft, the elements of the gripping member being configured to grip the neck of the shaft when the retaining portion is in the locked position.

8. The apparatus according to claim 1, wherein the apparatus includes one or more felt washers above and below the instrument on the shaft.

9. The apparatus according to claim 1, wherein the percussion instrument is a cymbal, bell, or gong.

10. The apparatus according to claim 1, wherein the elements of the gripping member are a pair of mutually spaced apart parallel rods, each rod positioned on opposing sides of a channel in the retaining portion to receive a free end of the shaft, the spacing of the rods in the first position being capable of retaining the shaft in the locked position, the or each spreader means being configured, upon actuation, to increase the distance between at least a portion of both rods and to move the rods into the second position.

11. The apparatus according to claim 10, wherein the rods are made of any flexible material.

12. The apparatus according to claim 10, wherein the or each spreader means is actuated by pressing the first section of the retaining portion, the first section being biased away from the second section by a spring member, the or each spreader means comprising two or more tapered protrusions on the first section, each protrusion being arranged, upon actuation, to engage with a corresponding recess between the parallel rods of the gripping member on the second section and configured to increase the distance between at least a portion of both rods.

13. The apparatus according to claim 12, wherein each protrusion has a truncated conical shape.

14. The apparatus according to claim 10, wherein the or each spreader means is actuated by pulling the first section of the retaining portion, the or each spreader means comprising two or more elongated activator pins, each activator pin having opposing ends, one end having a wider diameter than the other end, the narrow end of each activator pin being fixed to the first section of the retaining portion, the wide end of each activator pin being movably housed within a recess inside the second section and configured, upon actuation, to increase the distance between at least a portion of both rods of the gripping member.

15. The apparatus according to claim 10, wherein the or each spreader means is actuated by rotating the first section of the retaining portion about the second section, the or each spreader means comprising two or more activator pins, each activator pin having opposing ends, one end fixed to the first section of the retaining portion and the other end free to move within a circular indentation in the second section, the free end of each pin abutting a free end of a rod of the gripping member on the second section and configured, upon actuation, to increase the distance between at least a portion of both rods of the gripping member.

* * * * *